United States Patent [19]

Russell

[11] Patent Number: 4,841,581

[45] Date of Patent: Jun. 27, 1989

[54] DRAIN PLUG ASSEMBLY FOR DISHWASHER, AND THE LIKE

[76] Inventor: William K. Russell, 2715 Sparrow Cir., Costa Mesa, Calif. 92626

[21] Appl. No.: 48,950

[22] Filed: May 12, 1987

[51] Int. Cl.[4] ..... E03D 1/35

[52] U.S. Cl. ..... 4/400; 4/436; 137/119; 68/208; 134/186; 134/201

[58] Field of Search ..... 4/323, 378, 394, 397, 4/400, 436, 204, 245, 305, DIG. 3; 222/563; 137/119; 68/208; 134/143, 186, 201

[56] References Cited

U.S. PATENT DOCUMENTS

| | | | |
|---|---|---|---|
| 1,626,255 | 4/1927 | Roth | 4/DIG. 3 |
| 2,358,228 | 9/1944 | Hoof | 251/900 |
| 3,090,967 | 5/1963 | Erhardt et al. | 4/DIG. 3 |
| 3,902,201 | 9/1975 | Bobo | 137/119 X |
| 4,058,858 | 11/1977 | Che-Wei | 4/DIG. 3 |
| 4,086,929 | 5/1978 | Focht | 134/143 |
| 4,443,898 | 4/1984 | Aguero | 4/305 X |

*Primary Examiner*—Frankie L. Stinson
*Attorney, Agent, or Firm*—Willie Krawitz

[57] ABSTRACT

An assembly of a drain plug for a dishwasher is disclosed, comprising a hollow stem portion and a drain plug body. A double O-ring is provided to seat and seal the ball body into a drain pipe, and to make a light, sliding fit with the interior of the drain pipe. The sliding fit guides the assembly during vertical movement and enables the assembly to maintain a vertical position without tilting. When the O-rings become worn, they are replaced, rather than having to discard the entire assembly.

2 Claims, 1 Drawing Sheet

DRAIN PLUG ASSEMBLY FOR DISHWASHER, AND THE LIKE

BACKGROUND OF THE INVENTION

This invention relates to drain plug assemblies for use in dishwashers, and the like. Typically, dishwasher systems provide a sequence of wash, rinse and drain cycles. The drain cycle releases the wash water from the dishwasher, and fresh water is then introduced into the dishwasher to begin the next sequence of cycles.

A drain plug assembly is employed to release the wash water from the dishwasher, and it is controlled by a solenoid which is actuated by a timer. The drain plug is simply lifted by the solenoid and then reseats by gravity following release of the used washwater. It is, of course, imperative that when the drain plug reseats, a positive shut off is obtained.

Dishwasher systems also employ chemical injection pumps and recirculation pumps to supply water and other components such as detergent, sanitizing chemicals and rinse additives to the machine. These pumps are also controlled by the timer to insure that the rinse additive, detergent and sanitizer solutions are supplied during their respective cycles in correct amounts along with the water. Since the amount of water and the other components must be present in the dishwasher in controlled quantities, the water level in the dishwasher must be accurately controlled. However, if the drain plug does not seat or reseat properly, water levels cannot be accurately maintained, and the sanitary washing capabilities of the system will be compromised. Hence, the amount of chemical solution, and the water level in the machine are critical to a sanitary wash.

Typical drain plug assemblies are disclosed in U.S. Pat. Nos. 1,963,685; 2,276,670; 2,764,385; 2,879,026; 3,703,189; 4,351,355; and; 4,437,487.

Many problems caused by drain plug assemblies in dishwashers are due to misalignment of the drain plug in the drain pipe of the dishwasher system. This results in uneven wear of the drain plug and necessitates a premature replacement. Also, reduced water levels will occur due to leakage, and, as indicated, this will lessen the effectiveness of the dishwasher.

THE INVENTION

According to the invention, there is provided a new and improved drain plug assembly for dishwashers, and the like.

The drain plug assembly comprises a hollow stem portion, and a ball plug valve disposed in sealing relation to a drain pipe of a dishwasher. The ball plug includes a seating portion disposed upwardly of the drain pipe and seated thereon, and an inwardly tapered portion extending within the drain pipe itself. A double O-ring seal comprising a seating seal and a guide ring seal are disposed around the lower portion of the plug. When the drain plug is stationary, the main sealing function is performed by the seating seal. When the assembly is raised or lowered, the guide ring seal maintains the assembly vertically aligned within the drain pipe. Consequently, there is little or no tendency for the assembly to tilt out of its sealing alignment with the drain pipe. This in turn reduces the amount of water and detergent solution which leaks out of the dishwasher. Also, the guide ring aids in the sealing function when the assembly is stationary.

If particles such as food, broken glass, etc., enter into the seat area of the assembly, they will be drained from the system, rather than becoming stuck and wearing away the seals, drain plug, or drain seat.

BRIEF DESCRIPTION OF THE DRAWINGS

The single FIGURE is a cross sectional view in side elevation showing the drain plug assembly of this invention installed in a dishwashing system.

DESCRIPTION OF THE PREFERRED EMBODIMENTS

Figure 1:
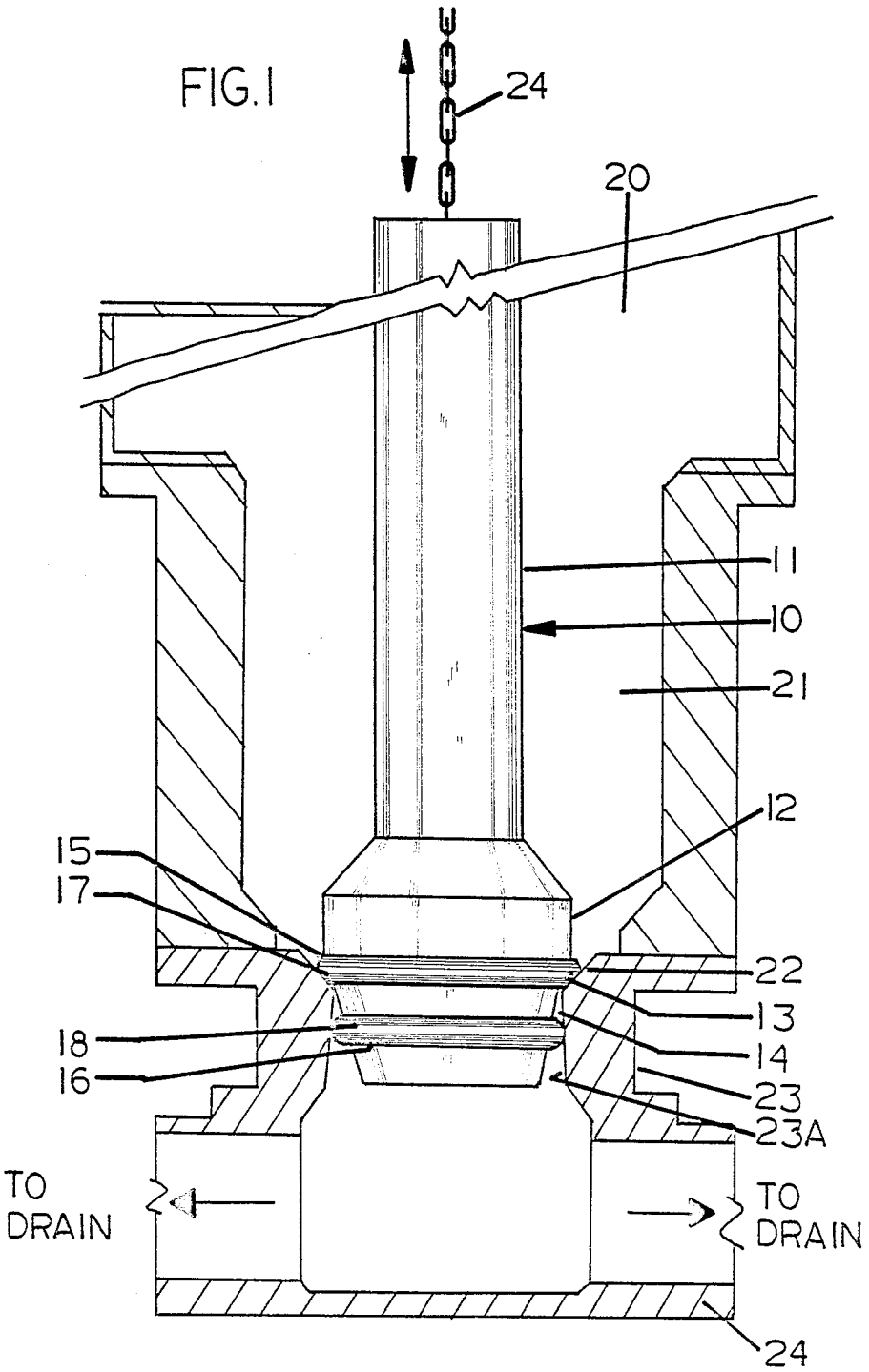

The drain plug assembly 10 of this invention is shown comprising a hollow stem element 11, and a lower ball plug element 12. The ball plug comprises a seating portion 13 and an inwardly tapered portion 14. Circumferential grooves 15 and 16 are defined on the seating and tapered portions 13, 14 respectively, each groove having a corresponding seating O-ring 17 and guide ring 18 mounted thereon. Typical materials of construction for the sealing and guide rings are HYPALON, VITON, and other plastics having resistance to highly corrosive detergent solutions. The stem portion and ball portion may be of stainless steel, PVC, etc.

The drain plug assembly is mounted within a connecting chamber comprising a dishwasher pan sump 20, drain sump 21, an inclined ball seat 22, drain pipe 23 defining an inner wall 23*a*, and a drain tee 24. The guide ring 18 contacts the inner wall 23*a* of the drain pipe 23 and forms a light, sliding fit therewith when the drain plug assembly 10 is raised or lowered. This enables the drain plug assembly to be maintained aligned in the drain pipe in a vertical orientation, and ensures proper seating and water levels.

The hollow stem element 11 of the drain plug assembly serves as an overflow drain, and this feature prevents flooding of the dishwasher. Also, use of the hollow stem enables a precise ratio of water to chemical solution to be maintained because it fixes the precise volume of water within the tank. When the appropriate amount and ratio of water to chemical solution is produced in the sumps 20 and 21, the solution mixture of water and chemical is pumped to the dishwasher in the appropriate timed sequence of wash and rinse cycles.

The upper end of the stem element 11 is attached by a chain 24 to a solenoid mechanism (not shown) which is actuated by a timer mechanism to control the rinse and wash cycles. Elevation of the drain ball assembly 10 by the chain 24 upon actuation of the solenoid permits wash solution from the dishmachine sump 20 and sump 21 to drain through the drain seat 22 and drain pipe 23 to sewer.

Use of the double O-ring design is critical to the seal of the drain plug because this simple feature allows easy replacement of the O-rings without replacing the complete drain plug assembly.

A leakage reduction of the wash and rinse solution of about 85% compared to prior art devices is obtained compared to prior art devices, using the drain plug assembly of this invention. This leakage reduction not only reduces costs for water and detergent solution, but also effects a much cleaner and more sanitary wash. In addition, there is less wear at the ball seat 22 and the O-rings 17 and 18 are easily replaced.

I claim:

1. A drain plug assembly for a dishwasher, including an interconnecting dishwasher sump, drain sump and, drain tee, the drain sump including an inclined ball seat and a connecting drain pipe defining an inner wall; the drain plug assembly comprising:

(a) a hollow, elongate stem, providing upper and lower ends, the upper end of the stem being connected to a solenoid switch, the stem extending upwardly through the drain sump and into the dishwasher sump;

(b) a ball body mounted adjacent the lower end of the elongate stem, and providing a circumferential groove thereon;

(c) an inwardly tapered extension terminating the lower end of the stem, and providing a circumferential groove thereon; and, (d) a replaceable, upper O-ring mounted within the groove on the ball body and a replaceable lower O-ring mounted within the groove on the tapered extension, the upper O-ring seating and sealing on the inclined ball seat, and the lower O-ring seating and sealing on the inner wall of the drain pipe; whereby:

(i) the ball body is moveable by gravity to seat and seal the inclined ball seat by contact with the upper O-ring thereon;

(ii) the tapered extension is adapted to guide the drain plug assembly in a vertically upright manner, without tilting, by forming a sliding fit with the lower O-ring and the inner wall of the drain pipe;

(iii) a constant level within the dishwasher and drain sumps is maintained by overflow of wash water through the hollow, elongate stem, thereby effecting a leakage reduction of about 85% of wash water; and, (iv) elevation of the drain plug assembly releases wash water from the dishwasher through the dishwasher sump, drain sump, drain seat and drain tee.

2. A method for reducing leakage from a dishwasher, including an interconnecting dishwasher sump, drain sump and drain tee, the drain sump including an inclined ball seat and a connecting drain pipe defining an inner wall, and for reducing wear of a drain plug assembly positioned at the drain seat, the said assembly comprising:

(a) a hollow, elongate stem, providing upper and lower ends, the upper ends of the stem being connected to a solenoid switch, the stem extending upwardly through the drain sump and into the dishwasher sump;

(b) a ball body mounted adjacent the lower end of the elongate stem, and providing a circumferential groove thereon;

(c) an inwardly tapered extension terminating the lower end of the stem, and providing a circumferential groove thereon; and, (d) a replaceable, upper O-ring mounted within the groove on the ball body and a replaceable, lower O-ring mounted within the groove on the tapered extension, the upper O-ring seating and sealing on the inclined ball seat, and the lower O-ring seating and sealing on the inner wall of the drain pipe; the method comprising:

(i) seating and sealing the inclined ball seat by gravity contact with the ball body and upper O-ring thereon;

(ii) guiding the tapered extension of the drain plug assembly in a vertically upright manner, without tilting, by forming a sliding fit with the lower O-ring and the inner wall of the drain pipe;

(iii) maintaining a constant level within the dishwasher and drain sumps by overflow of wash water through the hollow, elongate stem, thereby effecting a leakage reduction of about 85% of wash water; and, (iv) elevating the drain plug assembly to release wash water from the dishwasher through the dishwasher sump, drain sump, drain seat and drain tee.

* * * * *